US007086344B2

(12) United States Patent
Onweller

(10) Patent No.: US 7,086,344 B2
(45) Date of Patent: Aug. 8, 2006

(54) MARINE MOORING LINE VERMIN SHIELD

(76) Inventor: Arthur E. Onweller, 5052 S. Syndt Rd., Evergreen, CO (US) 80439

( * ) Notice: Subject to any disclaimer, the term of this patent is extended or adjusted under 35 U.S.C. 154(b) by 0 days.

(21) Appl. No.: 10/604,526

(22) Filed: Jul. 29, 2003

(65) Prior Publication Data

US 2005/0022710 A1 Feb. 3, 2005

(51) Int. Cl.
*B63B 21/12* (2006.01)

(52) U.S. Cl. ..... 114/221 R

(58) Field of Classification Search ..... 114/221 R
See application file for complete search history.

(56) References Cited

U.S. PATENT DOCUMENTS

| | | | | |
|---|---|---|---|---|
| 1,060,993 | A | 5/1913 | Maynard | |
| 1,401,540 | A | 12/1921 | Konig | |
| 1,486,417 | A | 3/1924 | Cheely | |
| 2,421,151 | A * | 5/1947 | Johnstone et al. | 114/221 R |
| 2,525,234 | A | 10/1950 | Mucke | 114/221 |
| 2,617,378 | A | 11/1952 | Osol | 114/221 |
| 3,005,436 | A | 10/1961 | Caldwell | 114/221 |
| 3,016,034 | A * | 1/1962 | Raistakka | 114/221 R |
| 3,753,416 | A | 8/1973 | Haglund et al. | 114/221 R |
| 4,570,564 | A | 2/1986 | Salvarezza | 114/221 R |
| 4,769,943 | A | 9/1988 | Simpson | 43/107 |
| 4,782,622 | A | 11/1988 | Roberts | 43/131 |
| 4,890,416 | A | 1/1990 | Roberts | 43/131 |
| 5,184,415 | A | 2/1993 | Hattenbach et al. | 43/58 |
| 5,570,652 | A * | 11/1996 | Ferland | 114/221 R |
| 6,011,219 | A | 1/2000 | Casmero | |
| D421,088 | S | 2/2000 | Douglas | D22/144 |
| 6,450,113 | B1 * | 9/2002 | Onweller | 114/221 R |
| 2005/0022711 | A1 * | 2/2005 | Onweller | 114/221 R |

* cited by examiner

*Primary Examiner*—Sherman Basinger
(74) *Attorney, Agent, or Firm*—Roger A. Jackson

(57) ABSTRACT

A marine mooring line vermin shield to prevent the passage of vermin crawling along a marine mooring line from land to a pleasure craft, including a disc with a centrally located aperture through the disc, and a slot extending from the aperture to a periphery of the disc. The vermin shield also includes a closure that is urged to insert into the disc slot in a closed state compressing the mooring line against the aperture to secure the vermin shield against the mooring line. The closure may also be locked in the closed state. The closure can also be extracted from the disc slot in an open state to allow the mooring line to be removed from the aperture through the slot past the disc periphery.

20 Claims, 5 Drawing Sheets

MARINE MOORING LINE VERMIN SHIELD

TECHNICAL FIELD

The present invention generally relates to vermin control in a marine environment. More particularly, the present invention relates to preventing the passage of vermin crawling along a mooring line of a recreational pleasure craft from the shoreline and onto the pleasure craft.

BACKGROUND OF INVENTION

It has long been recognized in the prior art the problem of a vermin infestation of marine vessels who migrate from the shore line whether it is a dock, a marina, a beach, or any other means possible with the vermin crawling from land onto the marine vessel wherein the vermin are attracted to food, water, and an enclave for nesting in the hold of the marine vessel. Once the vermin are on the marine vessel numerous problems arise, such as sanitation issues with the food and water supply of the marine vessel and other safety issues wherein the vermin can chew on wiring insulation in the hold of the vessel potentially causing electrical short circuits and possibly fires. Trapping and catching vermin has proved difficult as they are nocturnal animals, and can move very swiftly, and have the ability to squeeze through a very small crevices and openings in the hold of the vessel. Once the vermin have nested in the hold of the vessel it is typically required that the vessel be fumigated and then attempt to remove the dead vermin from the vessel. From the smallest to the largest vessels it is frequently very difficult even after fumigation to remove all of the dead vermin, which in time works to create unsanitary conditions from the decaying vermin carcasses.

As all marine vessels must of necessity be anchored or docked occasionally on either the beach or a dock where there is a mooring line that is strung between the cleats typically on the deck of the vessel and on the dock, or between the cleat on the deck of the vessel and an anchor that is on the shoreline. Even though the vessel is typically surrounded by least 6 ft. laterally of water, the vermin has ready access to the vessel by simply crawling along the mooring line from the dock or shoreline and onto the vessel itself. It has long been recognized in the prior art that the use of a shield barrier placed upon the mooring line to obstruct the vermin's ability to crawl along a mooring line and onto the ship is a solution to this problem.

Typical prior art solutions have included the use of a disc or a plurality of discs that are split in a semi circular fashion to be able to clamp upon the mooring line so that the disk assembly is secured in place upon the mooring line, as the mooring line is typically at an inclined angle with respect to the water level and the shoreline. A number of the prior art devices also include a vermin trap that sometimes has a poisonous substance inside wherein the vermin upon crawling up the mooring line and encountering the barrier are trapped inside the barrier and subsequently killed. U.S. Pat. No. 1,060,993 to Maynard and U.S. Pat. No. 4,890,416 to Roberts disclose this type of vermin guard. Other similar types of vermin guards do not have the vermin trap and poisonous substance, but are of a very similar design in other respects namely U.S. Pat. No. 1,401,540 to Konig, U.S. Pat. No. 1,486,417 to Cheely, U.S. Pat. No. 5,570,652 to Ferland, and U.S. Pat. No. 2,617,378 to Osol all utilize the aspect of only having a physical barrier to stop the vermin from migrating or crawling along the mooring line onto the vessel. There are some more unique designs of vermin guards for vessels that attempt to overcome specific problems, one of which is when a vermin guard is used on a very large vessel such as a ship, gaining physical access to the mooring line can be difficult as the mooring line can be suspended much higher than a human's height above the water level. It is typically desired that the vermin guard be placed at an appreciable distance from the dock or shoreline, being at least 6 ft. or so to preclude the vermin from easily getting access to the mooring line on the vessel side of the barrier. Thus, some of the vermin guards have been designed to be installed on the mooring line remotely from the vessel deck. This is accomplished through the use of remote ropes or cables to the vermin guard to allow the mooring line clamping mechanism of the vermin guard to be opened and to then be clamped upon the mooring line by an individual on the vessel deck utilizing the attached ropes or cables. Examples would be U.S. Pat. No. 4,570,564 to Salvarezza, U.S. Pat. No. 3,753,416 to Haglund et al., U.S. Pat. No. 3,005,436 to Caldwell, and U.S. Pat. No. 2,525,234 to Mucke of which all disclose the ability to remotely mount and dismount the vermin guard from the mooring line. Salvarezza and Haglund et al., utilize a swinging door closure that clamps on the mooring line by virtue of gravity, Caldwell utilizes a resilient member to clamp on the mooring line, and Mucke utilizes a spring clamp to secure the vermin guard to the mooring line. One other type of vermin guard utilizes only a repellent type substance wrapped around a mooring line absent a physical barrier for the vermin crawling along is disclosed in U.S. Pat. No. 4,769,943 to Simpson The majority of the aforementioned prior art has been designed for use with large vessels with the possible exception of Roberts and Simpson who both utilize a poisonous substance to prevent the vermin from crawling along the mooring line to the vessel. As the use of a poisonous substance in conjunction with pleasure craft or recreational boating is not desirable due to the presence of children and various other reasons, there remains a need for vermin guard that is specifically designed for smaller recreational pleasure marine craft that utilizes a physical barrier only without the use of a poisonous substance to prevent vermin from crawling along and mooring line. The vermin guard for smaller craft should also be small, lightweight, easy to install, inexpensive to produce, and desirably float on the water if the vermin guard were inadvertently dropped into the water.

SUMMARY OF INVENTION

An object of the present invention is to prevent the passage of vermin crawling along a marine mooring line form the shoreline and onto the pleasure craft.

It is another object of the present invention is to provide for easy installation and removal of the marine mooring line vermin shield from the mooring line.

It is still another object of the present invention to provide for a locking mechanism to selectively secure the marine mooring line vermin shield to the mooring line to help prevent theft of the mooring line vermin shield.

It is further another object of the present invention to accommodate a plurality of mooring line diameters or sizes.

According to the present invention, then, a marine mooring line vermin shield is provided to prevent the passage of vermin crawling along a marine mooring line from land to a pleasure craft. Broadly, the present invention includes a disc having a disc axial axis perpendicular to a face of the disc, the disc axial axis being positioned in a central portion of the disc. The disc also includes an aperture through the disc coincident to the disc axial axis being positioned such that the aperture uses the disc axial axis as a centerline, with the aperture being sized and configured as a passage for the marine mooring line. The disc also includes a radial slot through the disc coincident to the disc axial axis, the radial slot extending from the aperture to a periphery of the disc, with the slot having a radial axis parallel to the slot.

In addition, the present invention includes a closure sized and adapted to insert into the slot in a closure pivotal movement arc approximately parallel to the disc axial axis. The closure is in a closed state when inserted into the slot and is substantially flush with the disc face, the closure is also sized and adapted to manually extract from the slot in the closure pivotal movement arc approximately parallel to the disc axial axis. The closure is in an open state when extracted from the slot to allow the marine mooring line to pass through the slot from the periphery to the aperture. The closure also includes a first end that is substantially flush with the disc periphery when the closure is in the closed state, with the closure also including an opposing second end adapted to partially compress the mooring line against the aperture when the closure is in the closed state. Wherein the disc resists axial movement along the mooring line when the closure is in the closed state with the disc face generally perpendicular to a mooring line axial axis. Further included in the present invention is a means for urging the closure from the open state to the closed state.

These and other objects of the present invention will become more readily appreciated and understood from a consideration of the following detailed description of the exemplary embodiments of the present invention when taken together with the accompanying drawings, in which;

Figure 1:
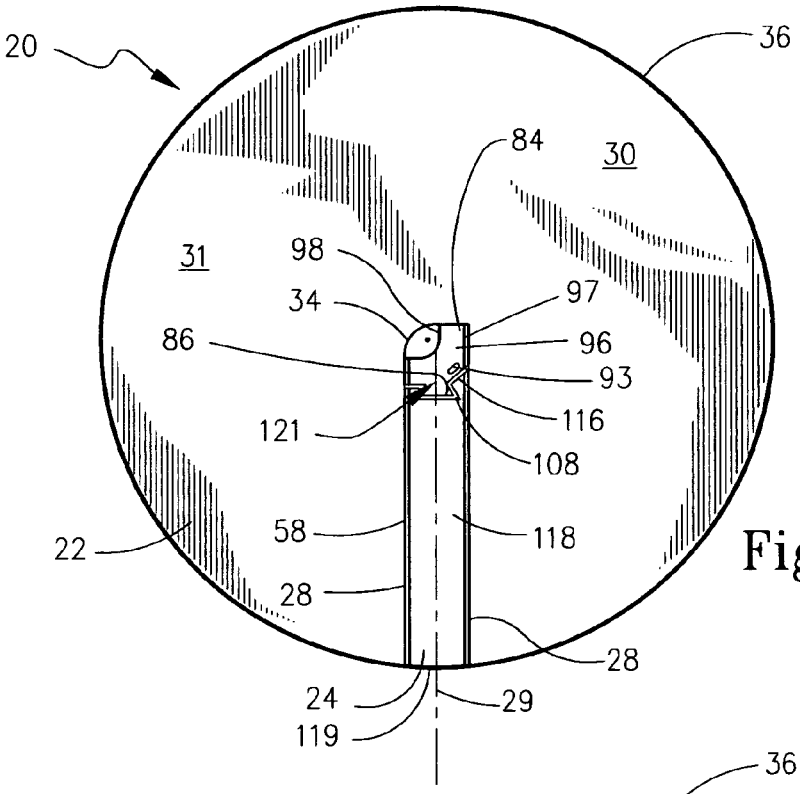
FIG. 1 shows a face front view of the marine mooring line vermin shield assembly with the closure including a removable aperture inserted into the disc slot, with the closure being in a closed state.

| REFERENCE NUMBER IN DRAWINGS | |
|---|---|
| 20 | Marine Mooring Line Vermin Shield Assembly |
| 22 | Disc |
| 24 | Closure |
| 25 | Closure pivotal movement arc |
| 26 | Means for urging closure from the open state to the closed state |
| 27 | Hinge pivot bolt rod |
| 28 | Slot opening in disc for mooring line |
| 29 | Slot opening radial axis in disc |
| 30 | Disc face |
| 31 | Placement area for pleasure craft registration number |
| 32 | Disc axial axis perpendicular to disc face |
| 34 | Disc aperture |
| 36 | Disc periphery |
| 40 | Lock |
| 41 | Key |
| 42 | Key hole |
| 44 | Disc closure rest |
| 50 | Lock extension |
| 52 | Lock fastener |
| 55 | Pivotal axis between closure and disc |
| 56 | First disc closure clearance |
| 57 | Spring element |
| 58 | Second disc closure clearance |
| 60 | First closure rest |
| 64 | Closure clearance taper |
| 69 | Compression of marine mooring line |
| 71 | Marine mooring line axial axis |
| 72 | Marine mooring line |
| 73 | Axial movement along marine mooring line |
| 74 | Land including shoreline or dock or marina |
| 76 | Body of water |
| 78 | Pleasure craft |
| 79 | Pleasure craft cleat |
| 80 | Vermin |
| 81 | Dock cleat |
| 82 | Anchor |
| 84 | Aperture insert |
| 86 | Aperture large dovetail protrusion |
| 88 | Aperture small dovetail protrusion |
| 90 | Aperture shoulder rest |
| 92 | Aperture retention snap protrusion |
| 93 | Aperture retention snap protrusion die clearance |
| 94 | Aperture axial guide surface |
| 96 | Aperture insert face |
| 97 | Aperture shoulder |
| 98 | Aperture mooring line surface |
| 99 | Aperture face recess |
| 100 | Aperture void |
| 102 | Aperture mooring line surface radius axis |
| 104 | Aperture mooring line surface radius |
| 106 | Aperture mooring line surface radius intersection with axis |

-continued

| REFERENCE NUMBER IN DRAWINGS | |
|---|---|
| 108 | Closure large dovetail void |
| 110 | Closure small dovetail void |
| 112 | Closure shoulder stop |
| 114 | Closure retention snap void |
| 116 | Closure axial guide surface or mooring line surface |
| 118 | Closure face |
| 119 | Closure first end |
| 120 | Closure finger pull |
| 121 | Closure second end |
| 122 | Closure pivot mounts |
| 124 | Disc reinforcing ribs |
| 126 | Disc pivot mounts |
| 128 | Hinge pivot retention nut |
| 130 | Line of demarcation from the aperture insert 84 large dovetail protrusion 86 removable engagement to the closure 24 large dovetail void 108 |
| 132 | Line of demarcation from the aperture insert 84 small dovetail protrusion 88 removable engagement to the closure 24 small dovetail void 110 |
| 134 | Line of demarcation from the aperture insert 84 shoulder rest 90 to the closure 24 shoulder stop 112 |
| 136 | Line of demarcation from the aperture insert 84 retention snap protrusion 92 to the closure 24 retention snap void 114 |
| 138 | Means for removably interlocking the aperture insert 84 and the closure second end 121 |

DETAILED DESCRIPTION

Figure 4:
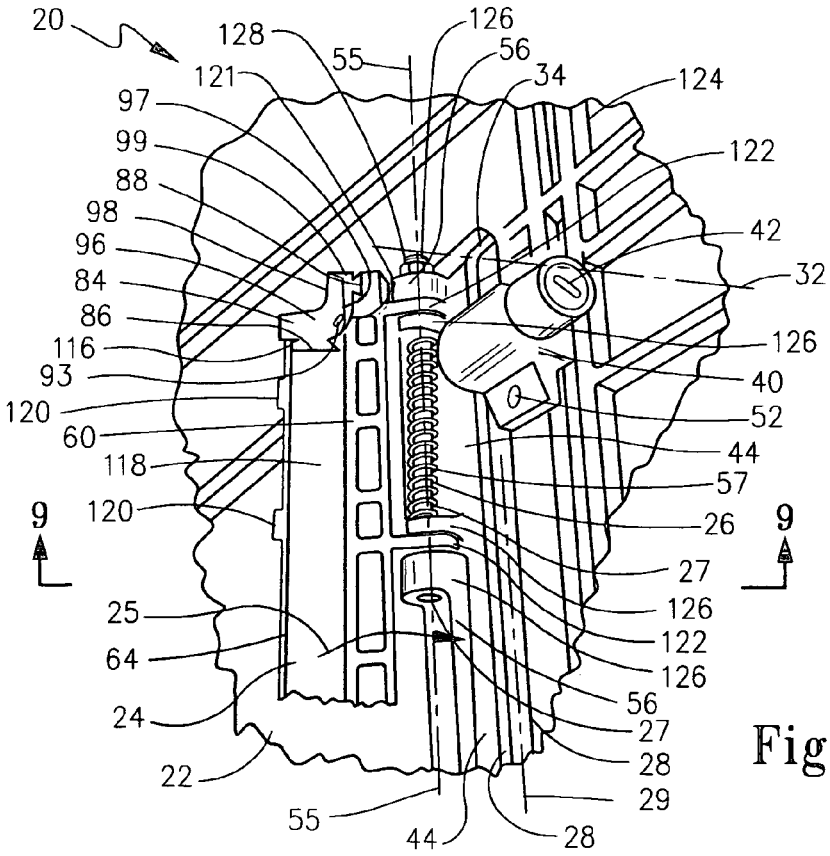
FIG. 4 shows a perspective view of the marine mooring line vermin shield assembly with the closure and the removable aperture extracted from the disc slot, resulting in the closure being in an unlocked and open state.

With initial reference to FIG. 1, shown is a face 30 front view of the marine mooring line vermin shield assembly 20 with the closure 24 having a removable aperture insert 84 with the closure 24 inserted into the radial disc slot 28, with the closure 24 being in a closed state. More specifically, the marine mooring line vermin shield assembly 20 is shown in a face 30 front view from the side opposite of the closure 24 pivotal attachment to the disc 22 to clearly identify the face 30 side of the disc 22. The mooring line vermin shield assembly 20 is shown with the disc face 30, which is the side that the vermin (not shown) would encounter while crawling along the mooring line (not shown) from land. This is desired as this face 30 is a substantially smooth or flush and continuous surface with the exception of the mooring line protruding therefrom thus making it difficult for the vermin to gain any traction to climb up the disc face 30 to get around the vermin shield 20 and continue upon the mooring line toward the pleasure craft (not shown) when the closure 24 is in the closed state. It is important to note that the closure 24, specifically the closure face 118, when in the closed state is substantially flush with the disc face 30 forming a continuous surface to effectively help block the vermin as previously described. In addition, the clearance gap between the closure 24 and the disc slot 28 is minimal to also prevent the vermin from overcoming the shield 20. The disc radial slot 28 through the disc 22 is coincident to the disc axial axis 32 (as shown in FIG. 4), with the radial slot 28 extending from the aperture 34 to a periphery 36 of the disc 22, the slot has a radial axis 29 parallel to the slot 28.

Figure 10:
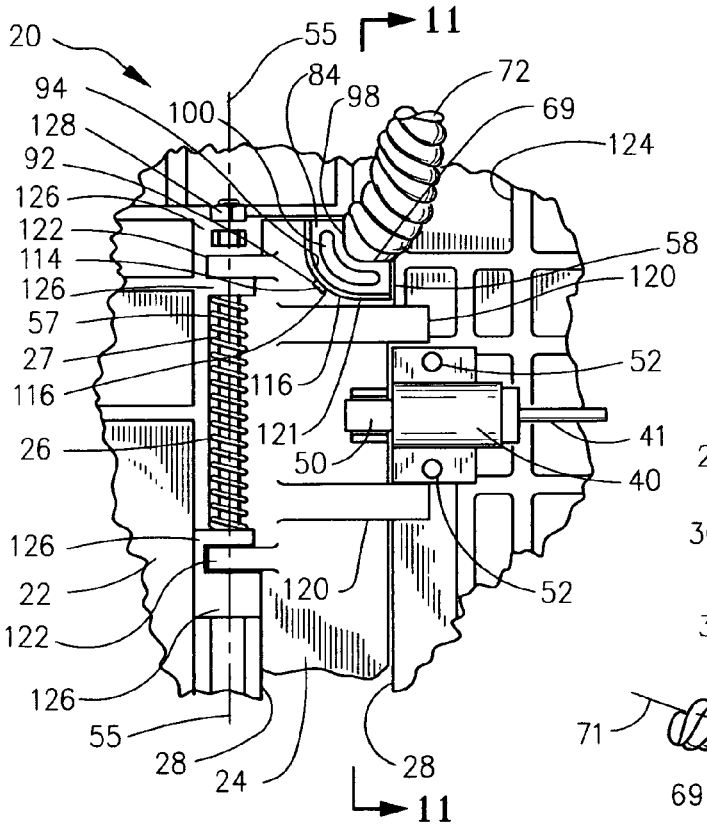
FIG. 10 shows an expanded back or rear view of the marine mooring line vermin shield assembly with the closure and the aperture insert both inserted into the disc slot, resulting in the closure being in a closed state secured by the lock and the marine mooring line compressed between the disc aperture and the aperture insert.
Figure 11:
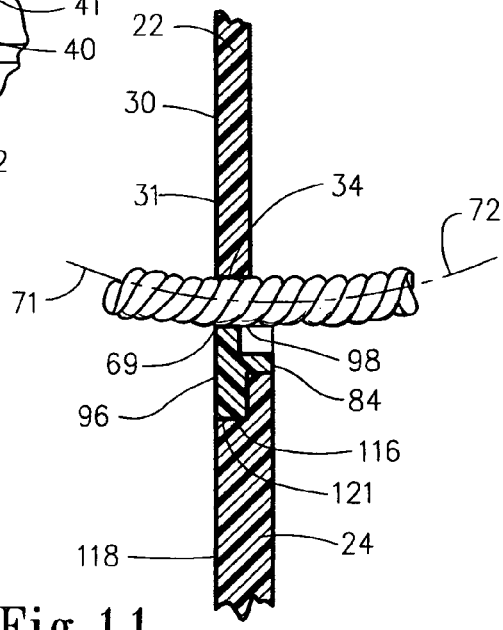
FIG. 11 shows section 11—11 from FIG. 10 of the marine mooring line vermin shield assembly with the closure and aperture insert inserted into the disc slot, resulting in the closure being in a closed state, the marine mooring line being compressed between the disc aperture and the aperture insert.

A mooring line passageway is formed by the disc aperture 34 and the aperture mooring line surface 98 of the aperture insert 84 or the closure mooring line surface 116, being a portion of the closure second end 121 as shown, if the aperture insert 84 is required depending upon the mooring line size as will be shown in FIG. 10 and FIG. 11. In other words, either the aperture mooring line surface 98 or as required for mooring line size the closure mooring line surface 116 act to compress the mooring line against the aperture 34 that is sized and configured as a passage for the marine mooring line (not shown).

Figure 12:
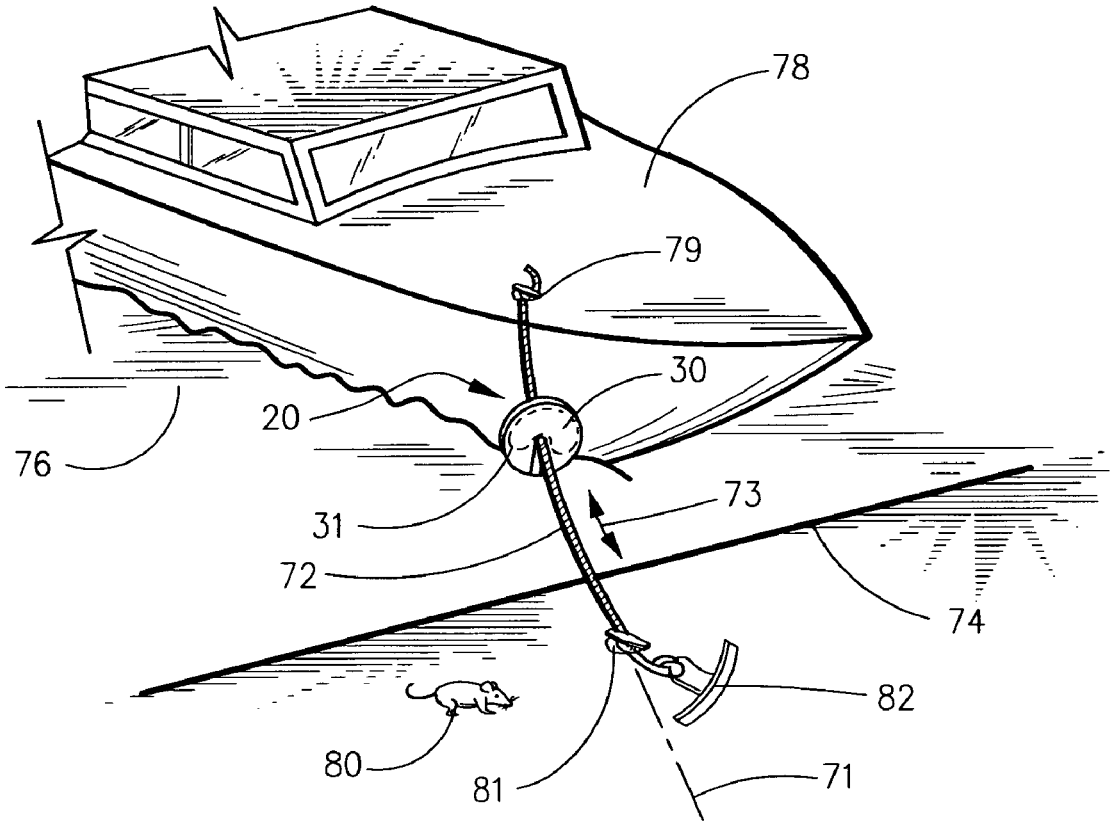
FIG. 12 shows the marine mooring line vermin shield assembly in use placed on a marine mooring line that secures the pleasure craft to the shoreline.

As an identification for the mooring vermin shield 20 the pleasure craft registration number can be added to the disc face 30 in the area shown by 31 to associate the vermin shield 20 to the pleasure craft, which is shown in FIG. 12. Also shown is the disc slot opening radial axis 29 and its relation to the second disc closure clearance 58 facing the non pivot end of the closure 24. The disc 22 has a periphery 36 with a closure first end 119 that is substantially flush with the disc periphery 36 when the closure 24 is in the closed state as shown to complete the formation of a nearly solid disc, being the combination of the disc 22 and the closure 24 when the closure 24 is in the closed state. The closure 24 first end 119 also includes an opposing second end 121 that in conjunction with the closure axial guide surface 116 is adapted to partially compress the mooring line against the aperture 34 when the closure is in the closed state, in other words when the aperture insert 84 is not required due to the size of the mooring line.

Looking more specifically to the aperture insert 84 shown is the aperture large dovetail protrusion 86 as it is slidably received into the closure large dovetail void 108 and the aperture retention snap protrusion die clearance 93. The aperture insert 84 also has a face 96 that is substantially flush with the disc face 30 when the closure 24 is in the closed state as shown. An aperture insert 84 shoulder 97 forms a minimal clearance gap with the slot opening 28 in the disc 22 when the closure 24 is in the closed state to further complete the formation of a nearly solid disc, being the combination of the disc 22, the closure 24, and with the aperture insert 84 when required when the closure 24 is in the closed state.

Figure 2:
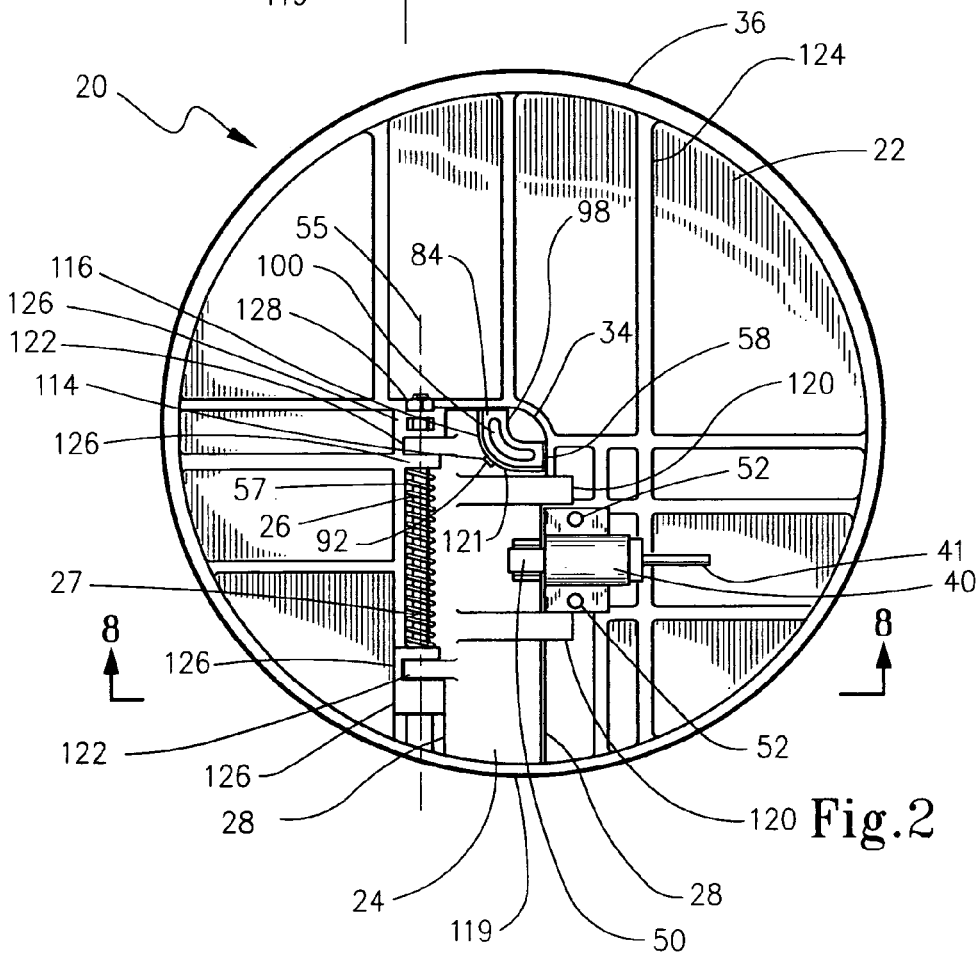
FIG. 2 shows a back or rear view of the marine mooring line vermin shield assembly with the closure including the removable aperture inserted into the disc slot, resulting in the closure being in a closed state secured by a lock.
Figure 8:
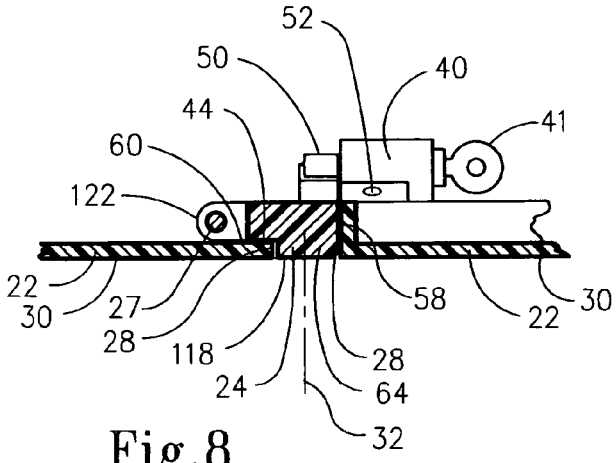
FIG. 8 shows section 8—8 from FIG. 2 of the marine mooring line vermin shield assembly with the closure inserted into the disc slot, resulting in the closure being in a closed state secured by the lock.
Figure 9:
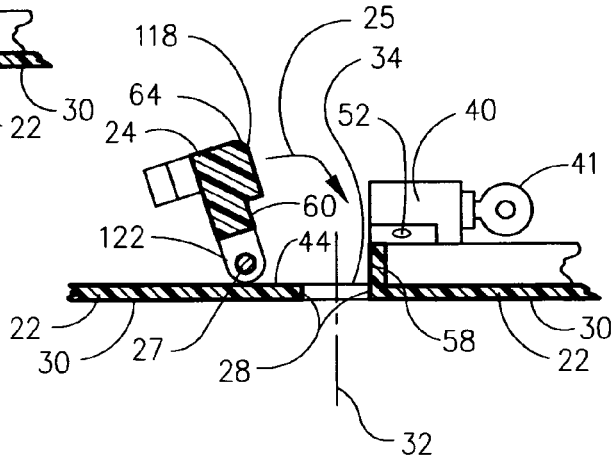
FIG. 9 shows section 9—9 from FIG. 4 of the marine mooring line vermin shield assembly with the closure extracted from the disc slot, resulting in the closure being in an open and unlocked state.

Looking next to FIG. 2, shown is a back or rear view of the marine mooring line vermin shield assembly 20 with the closure 24 and removable aperture 84 slidably engaged into the closure 24 second end 121, with the combination of the closure 24 and the aperture insert 84 inserted into the disc slot 28, resulting in the closure 24 being in a closed state secured by the lock 40. More specifically, the marine mooring line vermin shield assembly 20 is shown in a back view from the side opposite of the substantially flush disc face (not shown) to clearly identify the components of the closure 24, the means 26 for urging the closure 24 from the open state to the closed state 26, and the lock 40 with the locked extension 50 being extended to secure the closure 24 in the closed state. The lock 40 is shown with its key 41 that allows the lock extension 50 to slidably move to lock the closure 24 into the closed state and to allow the closure 24 to be placed into the open state as best shown in FIG. 8 and FIG. 9. The disc 22 as shown assumes a round periphery 36. Although the disk periphery 36 as shown is round in shape it would be acceptable for the disc periphery 36 to assume a number of different configurations depending upon manufacturing, shipping, and use considerations. The disk periphery 36 could be square, rectangular, elliptical, egg shaped, or a polygon with any number of multiple straight sides. As shown the disc 22 has multiple disc reinforcing rib 124 construction, alternatively the disc 22 could be of a solid non rib construction. Materials of construction for the disk 22 are preferably of a material that is both corrosion resistant in a marine atmosphere and a material that has a mass density less that the mass density of water, to allow the disk to float in water while supporting the additional elements of the closure 24, the aperture insert 84, the means 26 for urging the closure into a closed state, and the lock 40. The preferred materials of construction for the disk 22 include a plastic that is both light in weight, strong, and easily manufactured. These disc 22 materials of construction could include polyethylene, polypropylene, and polyurethane type materials, however, the disk 22 materials would not be limited to the aforementioned plastics as any suitable alternative material for both manufacturing and use of the disk 22 in a marine environment would be acceptable. The materials of construction for the closure 24 and the aperture insert 84 if required could match that of the aforementioned disc 22. Also shown is the aperture 34 of the disc 22 that is a partially circular opening that utilizes the disc axial axis (not shown) as a centerline. The opening formed by the disk 22 aperture 34 is tangential to one side of slot 28.

The closure 24 as shown is in the closed state by being inserted into the slot 28 as urged by the means 26 for urging the closure 24 from the open state to the closed state. A mooring line passageway is formed by the disc aperture 34 and the aperture mooring line surface 98 of the aperture insert 84 or the closure mooring line surface 116, or as shown, if the aperture insert 84 is required depending upon the mooring line size as will be shown in FIG. 10 and FIG. 11. In other words, either the aperture mooring line surface 98 or as required for mooring line size the closure mooring line surface 116 act to compress the mooring line (not shown) against the aperture 34.

The means 26 for urging the closure 24 from the open state into the closed state can be accomplished by any number of different elements. Preferably a spring element 57 positioned around the rod 27 outside diameter engaging the disc 22 on one end and the closure 24 on the other end is operational to accomplish the means 26 for urging the closure 24 from the open state into the closed state. Alternatively, a torsion rod, elastomeric element, or the like could be used to function as the means 26 for urging the closure 24 from the open state into the closed state while meeting the functional requirements and for operation in a marine environment. Preferably, as shown a hinge pivot bolt rod 27 having a pivotal axis 55 is mounted through disc pivot mounts 126 integral to the disc 22 and closure pivot mounts 122 integral to the closure 24 is utilized as shown. Lock fasteners 52 are shown for securing the lock 40 to the disc 22. These fasteners 52 for the lock 40 can be constructed of preferably stainless steel screws from materials being acceptable for a marine environment. Alternatively, rivets, bolts, or adhesive would be acceptable for the fasteners 52 as long as the operational requirements were met of having adequate attachment strength and suitability for a marine environment to secure the lock 40 to the disc 22. The rod 27 also includes a hinge pivot retention nut 128 that can be self locking to hold the rod 27 within the disc pivot mounts 126 and a spring element 57 to bias or urge the closure 24 to pivot into the closed state as shown. The function of the nut 128 could also be accomplished by swaging the rod 27 end, crimping a sleeve, having a shrink fit collar or any other element known in the art. The materials of construction of the rod 27 and the nut 128 are preferably stainless steel or from other materials being acceptable for a marine environment.

The closure 24 has a pair of finger pulls 120 to ease the manual operation of pivoting the closure 24 from the closed state to the open state. The disc 22 has a periphery 36 with a closure first end 119 that is substantially flush with the disc periphery 36 when the closure 24 is in the closed state as shown to complete the formation of a nearly solid disc, being the combination of the disc 22 and the closure 24 when the closure 24 is in the closed state. The closure 24 first end 119 also includes an opposing second end 121 that in conjunction with the closure axial guide surface 116 is adapted to partially compress the mooring line (not shown) against the aperture 34 when the closure is in the closed state, in other words when the aperture insert 84 is not required due to the size of the mooring line. Looking more specifically to the aperture insert 84 and the slidable engagement of the aperture insert 84 with the closure 24 second end 121, shown is a closure retention snap void 114 that removably interlocks with an aperture retention snap protrusion 92, and the second disc closure clearance 58 that is substantially consistent and minimized between the aperture insert 84 to the disc slot 28 and the closure 24 to the disc slot 28 when the closure 24 is in the closed state. Also shown is an aperture void 100 which is optional depending upon the size of aperture insert 84 required based upon mooring line size.

Figure 3:
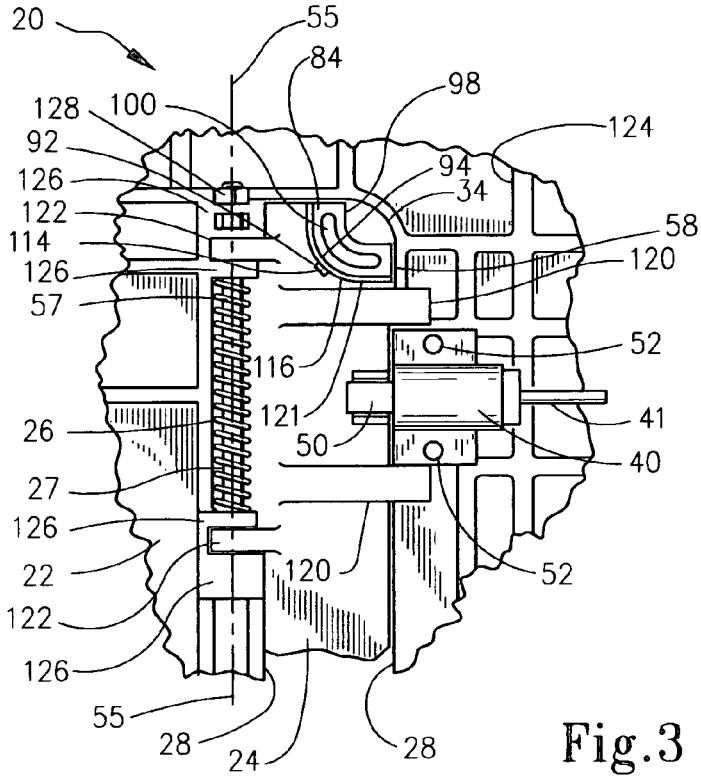
FIG. 3 shows an expanded back or rear view of the marine mooring line vermin shield assembly with the closure including the removable aperture inserted into the disc slot, resulting in the closure being in a closed state secured by the lock.

Further looking to FIG. 3 shown is an expanded back or rear view of the marine mooring line vermin shield assembly 20 with the closure 24 and removable aperture 84 slidably engaged into the closure 24 second end 121, with the combination of the closure 24 and the aperture insert 84 inserted into the disc slot 28, resulting in the closure 24 being in a closed state secured by the lock 40. More specifically, the marine mooring line vermin shield assembly 20 is shown in a back view from the side opposite of the substantially flush disc face (not shown) to clearly identify the components of the closure 24, the means 26 for urging the closure 24 from the open state to the closed state, and the lock 40 with the locked extension 50 being extended to secure the closure 24 in the closed state. The lock 40 is shown with its key 41 that allows the lock extension 50 to slidably move to lock the closure 24 into the closed state and to allow the closure 24 to be placed into the open state as best shown in FIG. 8 and FIG. 9. As shown the disc 22 has multiple disc reinforcing rib 124 construction, alternatively the disc 22 could be of a solid non rib construction. Also shown is the aperture 34 of the disc 22 that is a partially circular opening that utilizes the disc axial axis (not shown) as a centerline. The opening formed by the disk 22 aperture 34 is tangential to one side of slot 28.

The closure 24 as shown is in the closed state by being inserted into the slot 28 as urged by the means 26 for urging the closure 24 from the open state to the closed state. A mooring line passageway is formed by the disc aperture 34 and the aperture mooring line surface 98 of the aperture insert 84 or the closure mooring line surface 116, or as shown, if the aperture insert 84 is required depending upon the mooring line size as will be shown in FIG. 10 and FIG. 11. In other words, either the aperture mooring line surface 98 or as required for mooring line size the closure mooring line surface 116 act to compress the mooring line (not shown) against the aperture 34.

The means 26 for urging the closure 24 from the open state into the closed state can be accomplished by any number of different methods. Preferably a spring element 57 positioned around the rod 27 outside diameter engaging the disc 22 on one end and the closure 24 on the other end is operational to accomplish the means 26 for urging the closure 24 from the open state into the closed state. Alternatively, a torsion rod, elastomeric element, or the like could be used to function as the means 26 for urging the closure 24 from the open state into the closed state while meeting the functional requirements and for operation in a marine environment. Preferably, as shown a hinge pivot bolt rod 27 having a pivotal axis 55 is mounted through disc pivot mounts 126 integral to the disc 22 and closure pivot mounts 122 integral to the closure 24 as shown. Lock fasteners 52 are shown for securing the lock 40 to the disc 22. These fasteners 52 for the lock 40 can be constructed of preferably stainless steel screws from materials being acceptable for a marine environment. Alternatively, rivets, bolts, or adhesive would be acceptable for the fasteners 52 as long as the operational requirements were met of having adequate attachment strength and suitability for a marine environment to secure the lock 40 to the disc 22. The rod 27 also includes a hinge pivot retention nut 128 that can be self locking to hold the rod 27 within the disc pivot mounts 126 and a spring element 57 to bias or urge the closure 24 to pivot into the closed state as shown. The function of the nut 128 could also be accomplished by swaging the rod 27 end, crimping a sleeve, having a shrink fit collar or any other element known in the art. The materials of construction of the rod 27 and the nut 128 are preferably stainless steel or from other materials being acceptable for a marine environment.

Figure 7:
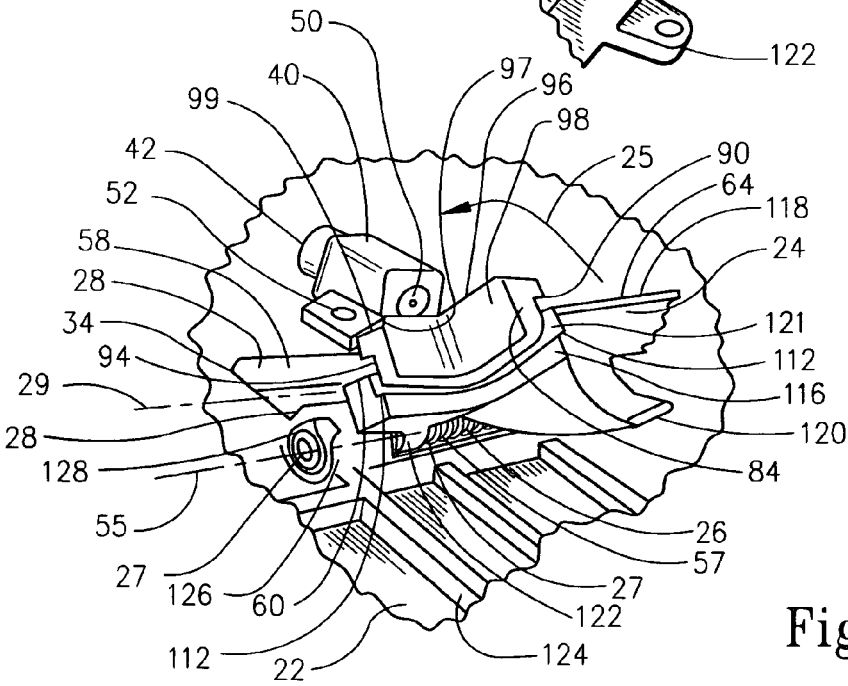
FIG. 7 shows a perspective view of the marine mooring line vermin shield assembly and in particular the closure extracted from the disc slot in an unlocked and open state, with the aperture insert partially engaged with the closure.

The closure 24 has a pair of finger pulls 120 to ease the manual operation of pivoting the closure 24 from the closed state to the open state. The closure 24 second end 121 that in conjunction with the closure axial guide surface 116 is adapted to partially compress the mooring line (not shown) against the aperture 34 when the closure is in the closed state, in other words when the aperture insert 84 is not required due to the size of the mooring line. Looking more specifically to the aperture insert 84 and the slidable engagement of the aperture insert 84 with the closure 24 second end 121 shown is a closure retention snap void 114 that removably interlocks with an aperture retention snap protrusion 92, and the second disc closure clearance 58 that is substantially consistent and minimized between the aperture insert 84 to the disc slot 28 and the closure 24 to the disc slot 28 when the closure 24 is in the closed state. Also shown is an aperture void 100 which is optional depending upon the size of aperture insert 84 required based upon mooring line size. The aperture axial guide surface 94 slidably contacts the closure axial guide surface 116 when the aperture insert is required (as is best shown in FIG. 7).

Moving next to FIG. 4 shown is a perspective view of the marine mooring line vermin shield assembly 20 with the closure 24 and the removable aperture 84 extracted from the disc slot 28, resulting in the closure 24 being in an unlocked and open state. More specifically, the marine mooring line vermin shield assembly 20 is shown in a back view from the side opposite of the substantially flush disc face (not shown) to clearly identify the components of the closure 24, the means 26 for urging the closure 24 from the open state to the closed state, and the lock 40 with the locked extension (not shown) being retracted to allow the closure 24 to be placed in the open state as shown. The lock 40 is shown with its key hole 42 extended outward that allows the lock extension to retract to have the lock 40 be in the unlocked state, and allow the closure 24 into the open state as best shown in FIG. 9. The lock 40 is preferably constructed of corrosion resistant material suitable for a marine environment. The lock 40 as shown with the key hole 42 is preferably a Prime-Line model number U-9862 available from Prime-Line, of San Bernardino, Calif. 92407, or other suitable alternative. As shown, the disc 22 has multiple disc reinforcing rib 124 construction, alternatively the disc 22 could be of a solid non rib construction. Also shown is the aperture 34 of the disc 22 that is a partially circular opening that is coincident to the disc axial axis 32 that is perpendicular to the disc face (not shown) as a centerline for the aperture 34. The disc axial axis 32 is positioned in a central portion of the disc 22. The opening formed by the disk 22 aperture 34 is tangential to one side of slot 28.

The closure 24 as shown is in the open state by being manually extracted from the slot 28 as manually urged using the closure finger pulls 120 against the means 26 for normally urging the closure 24 from the open state to the closed state. A mooring line passageway is formed by the disc aperture 34 and the aperture mooring line surface 98 of the aperture insert 84 or the closure mooring line surface 116, or as shown, if the aperture insert 84 is required depending upon the mooring line size as will be shown in FIG. 10 and FIG. 11. In other words, either the aperture mooring line surface 98 or as required for mooring line size the closure mooring line surface 116 act to compress the mooring line (not shown) against the aperture 34.

The means 26 for urging the closure 24 from the open state into the closed state can be accomplished by any number of different methods. Preferably a spring element 57 positioned around the rod 27 outside diameter engaging the disc 22 on one end and the closure 24 on the other end is operational to accomplish the means 26 for urging the closure 24 from the open state into the closed state. Alternatively, a torsion rod, elastomeric element, or the like could be used to function as the means 26 for urging the closure 24 from the open state into the closed state while meeting the functional requirements and for operation in a marine environment. Preferably, as shown a hinge pivot bolt rod 27 having a pivotal axis 55 is mounted through disc pivot mounts 126 integral to the disc 22 and closure pivot mounts 122 integral to the closure 24 as shown. Thus, the means 26 for urging the closure 24, being the rod 27 and spring 57 positioned on the rod 27 outside diameter is pivotally oriented along the pivotal axis 55 substantially parallel to the slot axis 29. The rod 27 and spring 57 can be constructed of preferably stainless steel or from other materials being acceptable being corrosion resistant for a marine environment. Lock fasteners 52 are shown for securing the lock 40 to the disc 22. These fasteners 52 for the lock 40 can be constructed of preferably stainless steel screws from materials being acceptable for a marine environment. Alternatively, rivets, bolts, or adhesive would be acceptable for the fasteners 52 as long as the operational requirements were met of having adequate attachment strength and suitability for a marine environment to secure the lock 40 to the disc 22. The rod 27 also includes a hinge pivot retention nut 128 that can be self locking to hold the rod 27 within the disc pivot mounts 126 and a spring element 57 to bias or urge the closure 24 to pivot into the closed state as shown. The function of the nut 128 could also be accomplished by swaging the rod 27 end, crimping a sleeve, having a shrink fit collar or any other element known in the art. The materials of construction of the nut 128 are preferably stainless steel or from other materials being acceptable for a marine environment.

The closure 24 has a pair of finger pulls 120 to ease the manual operation of pivoting the closure 24 from the closed state to the open state as shown. The closure 24 second end 121 that in conjunction with the closure axial guide surface 116 is adapted to partially compress the mooring line (not shown) against the aperture 34 when the closure is in the closed state, in other words when the aperture insert 84 is not required due to the size of the mooring line. Looking more specifically to the aperture insert 84 shown is the aperture large dovetail protrusion 86 as it is slidably received into the closure large dovetail void (not shown) and the aperture retention snap protrusion die clearance 93. The aperture insert 84 also has a face 96 that is substantially flush with the disc face (not shown) when the closure 24 is in the closed state. An aperture insert 84 shoulder 97 forms a minimal clearance gap with the slot opening 28 in the disc 22 when the closure 24 is in the closed state to further complete the formation of a nearly solid disc, being the combination of the disc 22, the closure 24, and with the aperture insert 84 when required when the closure 24 is in the closed state. In addition, an aperture small dovetail protrusion 88 is shown that is slidably engaged with the closure second end 121.

On the closure 24 itself, shown is the closure face 118 that is substantially flush with both the disc face (not shown) and the aperture insert face 96 when the closure 24 is in the closed state within the disc slot 28 along the slot opening radial axis 29 in the disc 22. Also adjacent to the aperture insert face 96 is a aperture shoulder 97 and an aperture face recess 99 which when the closure 24 is in the closed state the aperture face recess 99 rests against disc closure rest 44 in conjunction with a first closure rest 60. The first closure rest 60 in contacting the disc closure rest 44 acts as a gage stop to limit the means 26 for urging the closure 24 from the open state to the closed state, in effect setting the closed state position of the closure 24 in relation to the disc 22. The disc closure rest 44 is adjacent to a first disc closure clearance 56 that marks the transition from the disc closure rest 56 to the disc reinforcing ribs 124 and the disc pivot mounts 126. As the closure 24 moves from the open state to the closed state and vice versa, the closure travels through the closure pivotal movement arc 25, requiring that a closure clearance taper 64 be on the closure 24 to clear the slot opening 28 in the disc when the closure 24 travels through the closure pivotal movement arc 25 as best shown in FIG. 8 and FIG. 9.

The closure 24 is sized and adapted to insert into the slot 28 in a closure pivotal movement arc 25 approximately parallel to the disc axial axis 32. The closure 24 is in a closed state when inserted into the slot 28 and is substantially flush on the portion of the closure face 118 with the disc face (not shown). The closure 24 is also sized and adapted to manually extract from the slot 28 in the closure pivotal movement arc 25 approximately parallel to the disc axial axis 32, with the closure 24 being in an open state when extracted from the slot 28 to allow the marine mooring line (not shown) to pass through the slot 28 from the periphery (not shown) to the aperture 34. The closure 24 including a first end 119 substantially flush with the disc periphery 36 (as shown in FIG. 1) when the closure 24 is in the closed state. The closure 24 also including an opposing second end 121 is adapted to partially compress the mooring line against the aperture 34 if the aperture insert 84 is not required due to mooring line size, when the closure 24 is in the closed state. The disc 22 resists axial movement 73 along the mooring line 72 when the closure 24 is in the closed state with the disc face 30 generally perpendicular to the mooring line axial axis 71 as best shown in FIG. 12.

Figure 5:
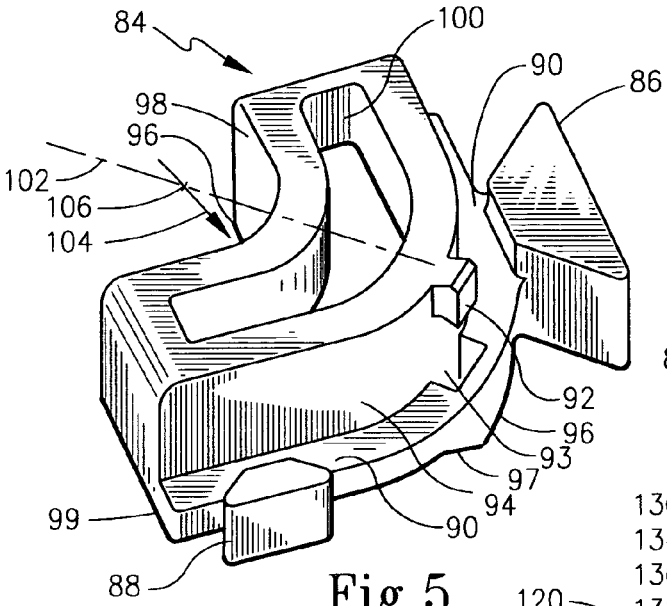
FIG. 5 shows an expanded perspective view of the aperture insert that that is removably engaged to the closure (not shown)
Figure 6:
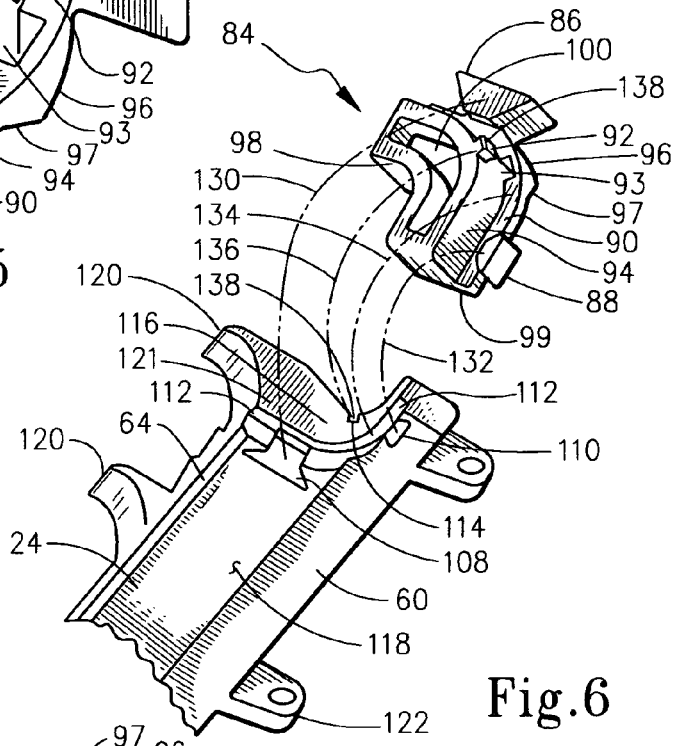
FIG. 6 shows an exploded perspective view of the aperture insert and the closure with lines of demarcation showing the removable engagement elements between the aperture insert and the closure.

Further to FIG. 5 shown is an expanded perspective view of the aperture insert 84 that that is removably engaged to the closure (not shown) however, as best shown in FIG. 6. The aperture insert 84 includes the large dovetail protrusion 86, the small dovetail protrusion 88, an aperture shoulder rest 90, and an aperture retention snap protrusion 92 which all act to force the aperture insert 84 into removable engagement with the closure, being specifically the closure second end (as shown in FIG. 6) to engage one another in a singular positional orientation. In other words, to force the aperture insert 84 to only engage one way into the closure second end thus allowing the aperture shoulder rest 90 and the aperture retention snap protrusion 92 to interface correctly with the closure second end. As a manufacturing convenience the aperture retention snap protrusion die clearance 93 facilitates the molding of the aperture retention snap protrusion 92. The aperture insert face 96 (as best shown in FIG. 4) also contains the aperture shoulder 97 that transitions to the aperture face recess 99 which rests against the disc closure rest (also as best shown in FIG. 4) that acts to further retain the aperture insert 84 from coming out of the face side of the disc working in conjunction with the aperture retention snap protrusion 92 to interface with the closure second end.

Further, the aperture insert 84 includes an aperture axial guide surface 94 that has a slidable interface with the closure second end (as best shown in FIG. 7). As the purpose of the aperture insert 84 is to accommodate different sizes of mooring lines, specifically relating to the mooring line diameter, an aperture mooring line surface radius 104 of varying dimension or length is utilized to accommodate the different diameters of mooring lines. This radius 104 defines the aperture mooring line surface 98 which in effect compresses the mooring line against the disc aperture (as best shown in FIG. 10 and FIG. 11). The radius 104 originates from an aperture mooring line surface radius axis 102 that is in a central portion of the aperture insert 84, wherein the radius 104 intersects the radius axis 102 at an aperture mooring line surface radius intersection 106. Note, that as the radius 104 changes in length for different mooring line diameters the intersection point 106 moves along the radius axis 102 to maintain a more circular aperture in the marine mooring line vermin shield assembly from the combination of the disc aperture and the aperture insert 84. In other words, as the disc aperture is fixed (see FIG. 1 element 34) in configuration curvature, as the radius 104 becomes longer, the intersection point 106 preferably shifts toward the aperture mooring line surface 98 to have a more symmetrically circular aperture in the marine mooring line vermin shield assembly from the combination of the disc aperture the aperture insert 84. If the intersection 104 did not shift in the aforementioned manner the aperture would appear somewhat quarter circular on shape causing a somewhat uneven compression of the mooring line in the marine mooring line vermin shield assembly from the combination of the disc aperture and the aperture insert 84.

Preferably, mooring line diameters accommodated are ½ inch, ⅝ inch, ¾ inch, ⅞ inch, and 1 inch, however, sizes either larger or smaller that the aforementioned could be easily accommodated by the present invention. Note that, on the largest size of mooring line diameter no aperture insert would by used as the closure second end alone would act to compress the mooring line, with smaller sizes of mooring using different aperture inserts 84 that each have a different length radius 104 with a preferably shifting intersection point 106 as previously discussed. Another manufacturing convenience is the aperture void 100 being utilized for the smaller radius 104 aperture inserts 84. The marine mooring line vermin shield assembly would typically include a plurality of aperture inserts 84 allowing a single marine mooring line vermin shield assembly to accommodate various mooring line sizes.

Next to FIG. 6 shown is an exploded perspective view of the aperture insert 84 and the closure 24 with lines of demarcation, identified as reference numbers 130, 132, 134, and 136 as subsequently described in detail, as depicting the removable engagement between the aperture insert 84 and the closure 24, or more specifically the closure second end 121. Starting with the aperture insert 84 that that is removably engaged to the closure 24, the aperture insert 84 includes the large dovetail protrusion 86, the small dovetail protrusion 88, an aperture shoulder rest 90, and an aperture retention snap protrusion 92 which all act to force the aperture insert 84 into a removable engagement with the closure 24, being specifically the closure second end 121 to engage one another in a singular positional orientation. In other words, to force the aperture insert 84 to only engage one way into the closure second end 121 thus allowing the aperture shoulder rest 90 and the aperture retention snap protrusion 92 to interface correctly with the closure second end 121 corresponding to the closure 24 shoulder step 112 and the closure 24 retention snap void 114 respectively. As a manufacturing convenience the aperture retention snap protrusion die clearance 93 facilitates the molding of the aperture retention snap protrusion 92. The aperture insert face 96 (as best shown in FIG. 4) also contains the aperture shoulder 97 that transitions to the aperture face recess 99 which rests against the disc closure rest (also as best shown in FIG. 4) that acts to further retain the aperture insert 84 from coming out of the face side of the disc working in conjunction with the aperture retention snap protrusion 92 to interface or removably engage with the closure 24 retention snap void 114.

Further, the aperture insert 84 includes an aperture axial guide surface 94 that has a slidable interface with the closure 24 axial guide surface 116 (as best shown in FIG. 7). Another manufacturing convenience is the aperture void 100 being utilized for the smaller radius 104 (as shown in FIG. 5) aperture inserts 84. The marine mooring line vermin shield assembly would typically include a plurality of aperture inserts 84 allowing a single marine mooring line vermin shield assembly to accommodate various mooring line sizes as the mooring line interfaces on the aperture mooring line surface 98.

Moving next to detail on the closure 24 a pair of finger pulls 120 is operational to ease the manual operation of pivoting the closure 24 from the closed state to the open state (as shown in FIG. 4 and FIG. 7). The closure 24 second end 121 that in conjunction with the closure axial guide surface 116 is adapted to partially compress the mooring line (not shown) against the aperture 34 (not shown) when the closure is in the closed state, in other words when the aperture insert 84 is not required due to the size of the mooring line. On the closure 24 itself, shown is the closure face 118 that is substantially flush with both the disc face (not shown) and the removably engaged (shown as separated) aperture insert face 96 when the closure 24 is in the closed state within the disc slot 28 (not shown). The first closure rest 60 contacts the disc closure rest (not shown) that acts as a gage stop to limit the closure positioning within the disc (not shown). As the closure 24 moves from the open state to the closed state and vice versa, the closure travels through the closure pivotal movement arc (not shown), requiring that a closure clearance taper 64 be on the closure 24 to clear the slot opening (not shown) in the disc when the closure 24 travels through the closure pivotal movement arc 25 as best shown in FIG. 8 and FIG. 9. Also shown on the closure 24 are the closure pivot mounts 122 as best functionally shown in FIG. 4.

The lines of demarcation depicting the sizing and configuring for the removable engagement receiving between the aperture insert 84 and the closure 24 or more specifically the closure second end 121 include; a line of demarcation 130 from the aperture insert 84 large dovetail protrusion 86 removable engagement to the closure 24 large dovetail void 108, a line of demarcation 132 from the aperture insert 84 small dovetail protrusion 88 removable engagement to the closure 24 small dovetail void 110, a line of demarcation 134 from the aperture insert 84 shoulder rest 90 to the closure 24 shoulder stop 112, and a line of demarcation 136 from the aperture insert 84 retention snap protrusion 92 to the closure 24 retention snap void 114 that acts as a means 138 for removably interlocking between the closure second end 121 and the aperture insert 84. Other means 138 for removably interlocking between the closure second end 121 and the aperture insert 84 would be acceptable such as marine set screws, a ball and spring arrangement, an annular recess and protrusion, and the like. The purpose of the large dovetail 86 and small dovetail 88 removable engagements with the corresponding large dovetail void 108 and small dovetail void 110 is to not only help to secure the aperture insert 84 to the closure second end 121, but to force a singular specific positional orientation of the aperture insert 84 into the closure second end 121. This is to allow the further retention of the aperture insert 84 into the closure second end 121 by use of the aperture retention snap protrusion 92 and aperture shoulder rest 90 to engage and interface with the closure retention snap void 114 and closure shoulder stop 112 respectively, when the aperture insert 84 is required based upon the mooring line diameter. As a larger mooring line diameter would not require use of the aperture insert 84 with the closure second end 121 itself compressing the mooring line.

Moving next to FIG. 7 shown is a perspective view of the marine mooring line vermin shield assembly and in particular the closure 24 extracted from the disc slot 28 in an unlocked and open state, with the aperture insert 84 partially engaged with the closure 24 second end 121. More specifically, the marine mooring line vermin shield assembly is shown in a back view from the side opposite of the substantially flush disc face (not shown) to clearly identify the components of the closure 24, the means 26 for urging the closure 24 from the open state to the closed state, and the lock 40 with the locked extension 50 being retracted to allow the closure 24 to be placed in the open state as shown. The lock 40 is shown with its key hole 42 (not shown) extended outward that allows the lock extension to retract to have the lock 40 be in the unlocked state, and allow the closure 24 into the open state as best shown in FIG. 9. As shown, the disc 22 has multiple disc reinforcing rib 124 construction, alternatively the disc 22 could be of a solid non rib construction. Also shown is the aperture 34 of the disc 22 that is a partially circular opening that utilizes the disc axial axis (not shown) as a centerline. The opening formed by the disk 22 aperture 34 is tangential to one side of slot 28.

The closure 24 as shown is in the open state by being manually extracted from the slot 28 as manually urged using the closure finger pulls 120 (only one is shown) against the means 26 for normally urging the closure 24 from the open state to the closed state. A mooring line passageway is formed by the disc aperture 34 and the aperture mooring line surface 98 of the aperture insert 84 or the closure mooring line surface 116, or as shown, if the aperture insert 84 is required depending upon the mooring line size as will be shown in FIG. 10 and FIG. 11. In other words, either the aperture mooring line surface 98 or as required for mooring line size the closure mooring line surface 116 act to compress the mooring line (not shown) against the aperture 34.

The means 26 for urging the closure 24 from the open state into the closed state can be accomplished by any number of different elements. Preferably a spring element 57 positioned around the rod 27 outside diameter engaging the disc 22 on one end and the closure 24 on the other end is operational to accomplish the means 26 for urging the closure 24 from the open state into the closed state. Alternatively, a torsion rod, elastomeric element, or the like could be used to function as the means 26 for urging the closure 24 from the open state into the closed state while meeting the functional requirements and for operation in a marine environment. Preferably, as shown a hinge pivot bolt rod 27 having a pivotal axis 55 is mounted through disc pivot mounts 126 integral to the disc 22 and closure pivot mounts 122 integral to the closure 24 as shown. Lock fasteners 52 (with only one shown) are for securing the lock 40 to the disc 22. These fasteners 52 for the lock 40 can be constructed of preferably stainless steel screws from materials being acceptable for a marine environment. Alternatively, rivets, bolts, or adhesive would be acceptable for the fasteners 52 as long as the operational requirements were met of having adequate attachment strength and suitability for a marine environment to secure the lock 40 to the disc 22. The rod 27 also includes a hinge pivot retention nut 128 that can be self locking to hold the rod 27 within the disc pivot mounts 126 and a spring element 57 to bias or urge the closure 24 to pivot into the closed state as shown. The function of the nut 128 could also be accomplished by swaging the rod 27 end, crimping a sleeve, having a shrink fit collar or any other element known in the art. The materials of construction of the spring element 57, rod 27, and the nut 128 are preferably stainless steel or from other materials being acceptable for a marine environment.

The closure 24 has a pair of finger pulls 120 to ease the manual operation of pivoting the closure 24 from the closed state to the open state as shown. The closure 24 second end 121 that in conjunction with the closure axial guide surface 116 is adapted to partially compress the mooring line (not shown) against the aperture 34 when the closure is in the closed state, in other words when the aperture insert 84 is not required due to the size of the mooring line. Looking more specifically to the aperture insert 84 shown is the face 96 that is substantially flush with the disc face (not shown) when the closure 24 is in the closed state. An aperture insert 84 shoulder 97 forms a minimal clearance gap with the slot opening 28 in the disc 22 when the closure 24 is in the closed state to further complete the formation of a nearly solid disc, being the combination of the disc 22, the closure 24, and with the aperture insert 84 when required when the closure 24 is in the closed state.

On the closure 24 itself, shown is the closure face 118 that is substantially flush with both the disc face (not shown) and the aperture insert face 96 when the closure 24 is in the closed state within the disc slot 28 along the slot opening radial axis 29 in the disc 22. Also adjacent to the aperture insert face 96 is a aperture shoulder 97 and an aperture face recess 99 which when the closure 24 is in the closed state the aperture face recess 99 rests against disc closure rest (not shown) in conjunction with a first closure rest 60. As the closure 24 moves from the open state to the closed state and vice versa, the closure travels through the closure pivotal movement arc 25, requiring that a closure clearance taper 64 be on the closure 24 to clear the slot opening 28 or more specifically the second disc closure clearance 58 in the disc when the closure 24 travels through the closure pivotal movement arc 25 as best shown in FIG. 8 and FIG. 9.

Looking in particular at the Aperture insert 84 and closure second end 121 removable engagement the aperture insert 84 as shown includes the aperture axial guide surface 94 that is slidably engaged with the closure axial guide surface 116, plus the aperture shoulder rest 90 that rests against the closure shoulder stop 112 to set the axial positioning relationship between the aperture insert 84 and the closure 24.

Further looking next to FIG. 8 shown is section 8—8 from FIG. 2 of the marine mooring line vermin shield assembly with the closure 24 inserted into the disc slot 28, resulting in the closure 24 being in a closed state secured by the lock 40. Starting with the disc face 30, note that the closure 24 is sized and adapted to insert into the slot 28 such that the disk face 30 and closure 24 face 118 form a substantially flush surface, as the disc face 30 is what the vermin (not shown) will encounter when crawling up the mooring line (not shown). As the closure 24 is shown in the closed state, the closure 24 is urged into that position by the means (not shown) for urging the closure 24 into the closed state. For the portion that is shown, the means for urging the closure includes the rod 27 and the closure pivot mount 122 with the disc pivot mount removed for clarity. As it is desirable to have the closure 24 face 118 be substantially flush with the disc face 30 of the disk 22 when the closure 24 is in the closed state and to provide a positional stop for the means for urging the closure 24 into the closed state within the disc slot 28, that is substantially symmetric about the disc axial axis 32, there are contacting surfaces between the closure 24 and the disc 22. These are the first closure rest 60 that contacts the disc closure rest 44. There is a gap shown in FIG. 8 between these closure rest 60 and disc rest 44 for pictorial clarity, however, in actuality the aforementioned closure rest 60 and disc rest 44 are in contact and act as a gauge to set the closure 24 positioning within the disc slot 28. The result of this is to form a substantially flush disc face with the closure 24 in a closed state at the disc face 30.

The lock 40 with its key 41 is also shown in a locked state with the locked extension 50 extended to prevent the closure 24 from being extracted from the slot 28 into the open state, and other words the lock 40 and extension 50 as shown act to secure the closure 24 in the closed state as shown to help prevent theft of the mooring line vermin shield from the mooring line (not shown). Fasteners 52 (one fastener is shown) are shown for securing the lock 40 to the disc 22. These fasteners 52 for the lock 40 can be constructed of preferably stainless steel screws from materials being acceptable for a marine environment. Alternatively, rivets, bolts, or adhesive would be acceptable for the fasteners 52 as long as the operational requirements were met of having adequate attachment strength and suitability for a marine environment to secure the lock 40 to the disc 22. Note that the lock 40 could be optional as it is not essential to the function of the marine mooring line vermin shield and acts only to help prevent theft of the marine mooring line vermin shield from the mooring line.

The closure 24 also includes closure clearance taper 64, which allows the closure 24 to be extracted and inserted into the slot 28 and in particular near the second disc closure clearance 58 utilizing the rod 27 as a pivot when the closure is moved from the open state to the closed state and vice versa with the lock 40 in the unlocked state. This essentially allows a "swing" clearance for the closure 24 for insertion and extraction from the slot 28.

Further on to FIG. 9 shown is section 9—9 from FIG. 4 of the marine mooring line vermin shield assembly with the closure 24 extracted from the disc slot 28, resulting in the closure 24 being in an open and unlocked state. Starting with the disc face 30, note that the closure 24 is extracted along the closure pivotal movement arc 25 from the slot 28. As the closure 24 is shown in the open state, the closure 24 is manually moved against the means for urging into that position by the closure finger pulls (not shown) for moving the closure 24 into the open state from the closed state. For the portion that is shown, the means for urging the closure includes the rod 27 and the closure pivot mount 122 with the disc pivot mount removed for clarity. As it is desirable to have the closure 24 face 118 be substantially flush with the disc face 30 of the disk 22 when the closure 24 is in the closed state and to provide a positional stop for the means for urging the closure 24 into the closed state within the disc slot 28, that is substantially symmetric about the disc axial axis 32, there are contacting surfaces between the closure 24 and the disc 22. These are the first closure rest 60 that contacts the disc closure rest 44 (as best shown in FIG. 8).

The lock 40 with its key 41 is also shown in the unlocked state with the locked extension 50 (not shown) retracted to allow the closure 24 to be manually extracted from the slot 28 into the open state. Fasteners 52 are shown for securing the lock 40 to the disc 22. These fasteners 52 (one fastener is shown) for the lock 40 can be constructed of preferably stainless steel screws from materials being acceptable for a marine environment. Alternatively, rivets, bolts, or adhesive would be acceptable for the fasteners 52 as long as the operational requirements were met of having adequate attachment strength and suitability for a marine environment to secure the lock 40 to the disc 22. Note that the lock 40 could be optional as it is not essential to the function of the marine mooring line vermin shield and acts only to help prevent theft of the marine mooring line vermin shield from the mooring line.

The closure 24 also includes closure clearance taper 64, which allows the closure 24 to be extracted and inserted into the slot 28 and in particular near the second disc closure clearance 58 utilizing the rod 27 as a pivot when the closure is moved from the open state to the closed state and vice versa along the closure pivotal movement arc 25 with the lock 40 in the unlocked state. This essentially allows a "swing" clearance for the closure 24 for insertion and extraction from the slot 28. Also visible is the disc aperture 34 when the closure 24 is in the open state.

Proceeding on to FIG. 10 shown is an expanded back or rear view of the marine mooring line vermin shield assembly 20 with the closure 24 and the aperture insert 84 both inserted into the disc slot 28, resulting in the closure 24 being in a closed state secured by the lock 40 and the marine mooring line 72 compressed between the disc aperture (not shown) and the aperture insert 84. More specifically, the marine mooring line vermin shield assembly 20 is shown in a back view from the side opposite of the substantially flush disc face (not shown) to clearly identify the components of the closure 24, the means 26 for urging the closure 24 from the open state to the closed state, and the lock 40 with the locked extension 50 being extended to secure the closure 24 in the closed state. The lock 40 is shown with its key 41 that allows the lock extension 50 to slidably move to lock the closure 24 into the closed state and to allow the closure 24 to be placed into the open state as best shown in FIG. 8 and FIG. 9. As shown the disc 22 has multiple disc reinforcing rib 124 construction, alternatively the disc 22 could be of a solid non rib construction. Also the aperture of the disc 22 that is a partially circular opening that utilizes the disc axial axis (not shown) as a centerline (as best shown in FIG. 3). The opening formed by the disk 22 aperture is tangential to one side of slot 28.

The closure 24 as shown is in the closed state by being inserted into the slot 28 as urged by the means 26 for urging the closure 24 from the open state to the closed state. A mooring line passageway is formed by the disc aperture and the aperture mooring line surface 98 of the aperture insert 84 or the closure mooring line surface 116, (again as best shown in FIG. 3) or as shown, if the aperture insert 84 is required depending upon the mooring line size as will be also shown FIG. 11. In other words, either the aperture mooring line surface 98 or as required for mooring line size the closure mooring line surface 116 act to compress the mooring line 72 against the aperture.

The means 26 for urging the closure 24 from the open state into the closed state can be accomplished by any number of different methods. Preferably a spring element 57 positioned around the rod 27 outside diameter engaging the disc 22 on one end and the closure 24 on the other end is operational to accomplish the means 26 for urging the closure 24 from the open state into the closed state. Alternatively, a torsion rod, elastomeric element, or the like could be used to function as the means 26 for urging the closure 24 from the open state into the closed state while meeting the functional requirements and for operation in a marine environment. Preferably, as shown a hinge pivot bolt rod 27 having a pivotal axis 55 is mounted through disc pivot mounts 126 integral to the disc 22 and closure pivot mounts 122 integral to the closure 24 as shown. Lock fasteners 52 are shown for securing the lock 40 to the disc 22. These fasteners 52 for the lock 40 can be constructed of preferably stainless steel screws from materials being acceptable for a marine environment. Alternatively, rivets, bolts, or adhesive would be acceptable for the fasteners 52 as long as the operational requirements were met of having adequate attachment strength and suitability for a marine environment to secure the lock 40 to the disc 22. The rod 27 also includes a hinge pivot retention nut 128 that can be self locking to hold the rod 27 within the disc pivot mounts 126 and a spring element 57 to bias or urge the closure 24 to pivot into the closed state as shown. The function of the nut 128 could also be accomplished by swaging the rod 27 end, crimping a sleeve, having a shrink fit collar or any other element known in the art. The materials of construction of the spring element 57, rod 27, and the nut 128 are preferably stainless steel or from other materials being acceptable for a marine environment.

The closure 24 has a pair of finger pulls 120 to ease the manual operation of pivoting the closure 24 from the closed state to the open state. The closure 24 second end 121 that in conjunction with the closure axial guide surface 116 is adapted to partially compress 69 the mooring line 72 against the aperture when the closure is in the closed state, in other words when the aperture insert 84 is not required due to the size of the mooring line. Looking more specifically to the aperture insert 84 and the slidable engagement of the aperture insert 84 with the closure 24 second end 121 shown is a closure retention snap void 114 that removably interlocks with an aperture retention snap protrusion 92, and the second disc closure clearance 58 that is substantially consistent and minimized between the aperture insert 84 to the disc slot 28 and the closure 24 to the disc slot 28 when the closure 24 is in the closed state. Also shown is an aperture void 100 which is optional depending upon the size of aperture insert 84 required based upon mooring line size. The aperture axial guide surface 94 slidably contacts the closure axial guide surface 116 when the aperture insert is required (as is best shown in FIG. 7).

Further proceeding on to FIG. 11 shown is section 11—11 from FIG. 10 of the marine mooring line vermin shield assembly with the closure 24 and aperture insert 84 inserted into the disc 22 slot (not shown), resulting in the closure being in a closed state, the marine mooring line 72 being compressed 69 between the disc aperture 34 and the aperture insert 84. The mooring line 72 is shown passing through the passageway formed by the aperture 34 and the aperture mooring line surface 98 of the aperture insert 84 or the closure mooring line surface 116, (again as best shown in FIG. 3) or as shown, if the aperture insert 84 is required depending upon the mooring line 72 diameter. In other words, either the aperture mooring line surface 98 or as required for the mooring line 72 diameter the closure mooring line surface 116 being a portion of the closure second end 121 act to compress the mooring line 72 against the aperture 34. When the closure 24 is in the closed state the aperture insert when properly installed has a face 96 that is substantially flush with both the disc face 30 and the closure face 118.

Thus, with the closure 24 being in the closed state, more particularly, shown is the compression 69 of the mooring line 72 between the aperture 34 and either the aperture insert 84 of the closure mooring line surface 116. This compression of the mooring line 72 occurs at the portion of the mooring line 72 identified as compression 69 with the purpose of securing the mooring line vermin shield assembly 20 from axial movement along the mooring line 72 approximately along the mooring line axial axis 71. In addition, the aforementioned securing compression 69 of the mooring line 72 helps to keep the disk face 30 generally perpendicular to the mooring line axial axis 71, with the purpose being to maximize the difficulty for the vermin crawling along the mooring line 72 to overcome the shield assembly 20 in attempting to gain passage to the pleasure craft on the opposite side of the vermin shield assembly 20 as best shown in FIG. 12. Also shown is the placement area for the pleasure craft registration number 31 being on the same side as the disc face 30. The mooring line 72 which is termed in the art as either nylon anchor line, nylon mooring line, braided nylon anchor line, twisted nylon anchor line, or poly anchor line is preferred as it is required that the mooring line be compressible to some extent. The amount of compression on the mooring line 72 when the closure 24 is in the closed state for the purpose of securing the vermin shield assembly 20 to the mooring line 72 is preferably about one sixteenth of an inch as previously described.

Method of Use

Finally, looking to FIG. 12 shown is the marine mooring line vermin shield assembly 20 in use placed on a marine mooring line 72 that secures the pleasure craft 78 to the shoreline 74 or dock 74. Starting with the pleasure craft 78 which can be a conventional speedboat, water skiing boat, small fishing boat, sailboat, a houseboat, or any other type of smaller marine craft. The pleasure craft 78 is floating in the body of water 76 in close proximity to land, which includes either an undeveloped shoreline 74 or a dock 74 or a marina 74. There is a deck cleat 79 shown on the pleasure craft 78 for attaching the mooring line 72 to the deck of the pleasure craft 78. Normally the other end of the mooring line 72 will either be secured to a dock cleat 81 that is mounted to the dock or marina 74 or in the case where there is no dock or marina an anchor will be used 82 that is attached to the other end of the mooring line 72 that is secured to the shoreline 74 by either burying the anchor 82 along the shoreline or securing the anchor to a rock and the like. Although a singular mooring line 72 is shown for pictorial simplicity, typically a plurality of mooring lines 72 are used to prevent the pleasure craft 78 from swinging in a pendulum type action in relation to the dock or shoreline 74 from either wind or water currents thus potentially causing damage to the pleasure craft 78 from the pleasure craft 78 contacting the dock or shoreline 74. In most cases, two mooring lines 72 are used to secure the pleasure craft 78 from the potentially damaging pendulum swinging motion. For an even larger pleasure craft 78 such as a houseboat, four mooring lines 72 are typically used to secure the pleasure craft 78 from the potentially damaging pendulum swinging motion. Note that, each mooring line 72 requires at least one mooring line vermin shield assembly 20, thus most pleasure craft 78 would require two to four mooring line vermin shield assemblies 20.

The principal purpose of the mooring line vermin shield assembly 20 is to prevent the passage of a vermin 80 from crawling along the mooring line 72 from the dock 74, marina 74, or shoreline 74 and onto the pleasure craft 78. The mooring line vermin shield assembly 20 is provided that includes a disc, with an aperture, and a slot, also a closure, an aperture insert, a lock, and a means for urging the closure to insert into the slot resulting in the closure being in a closed state as previously described. To install the mooring line vermin shield assembly 20 the closure must be manually extracted from the slot, which requires that the means for urging the closure to insert into the slot must be manually overcome to extract the closure from the slot thus opening up the slot into the aperture that is placed at the center of the disc moving the closure from the closed state to the open state. Next, the size or diameter of the mooring line 72 needs to be determined or ascertained. Further a step of engaging the aperture insert into the closure if required based upon the determined size of the mooring line and at this point the mooring line vermin shield assembly 20 is ready to be positioned onto the mooring line 72 such that the mooring line 72 passes through the slot of the disc to rest against the disc aperture. It is important to note that the disc face 30 should be positioned on the mooring line 72 to face the dock 74 or shoreline 74 as shown. This is to ensure that the substantially flush disk surface 30 is the barrier that the vermin 80 encounters first while crawling along the mooring line 72 from the dock 74, marine 74, or shoreline 74. The next step would be to allow the means for urging the closure to insert the closure into the slot, thus putting the closure in the closed state, wherein at this point the closure will compress the mooring line 72 against the aperture of the disc and securing the mooring line vermin shield assembly 20 against axial movement 73 along a mooring line axial axis 71. The securing of the mooring line vermin shield assembly 20 to the mooring line 72 accomplishes three basic purposes, the first is to secure the vermin shield assembly 20 from moving along the mooring line 72 in the direction of axial movement along the mooring line 73, as the mooring line 72 is typically inclined as shown, secondly it is important to maintain the disc face 30 generally perpendicular to the mooring line axial axis 71 to maximize the barrier effect against the vermin 80. Thirdly, an optional lock can be used on the mooring line vermin shield assembly 20 to secure the closure in a closed state thus helping prevent theft of the mooring line vermin shield assembly 20. Additionally, it is important to position the mooring line vermin shield assembly 20 axially on the mooring line 72 a sufficient distance from the dock or shoreline 74 such that the vermin 80 cannot jump or leap onto the mooring line 72 that is between the mooring line vermin shield assembly 20 and the pleasure craft 78 thus allowing the vermin 80 to overcome the barrier. It is recommended the mooring line vermin shield assembly 20 be positioned on the mooring line 72 at an axial location approximately one half way between the shoreline anchor 82, dock cleat 81, dock 74, or shoreline 74, and the pleasure craft 78 or the mooring line cleat 79 on the pleasure craft 78. Optionally, an identification for the mooring vermin shield 20 the pleasure craft registration number can be added to the disc face 30 in the area 31 to associate the mooring line vermin shield 20 to the pleasure craft 78.

Optional further steps could include providing the marine mooring line vermin shield assembly 20 with a plurality of aperture inserts to be selected from based upon mooring line size if required. Also, a step could be included of engaging a selected aperture insert into the closure if required based upon the size of the mooring line.

Comparing the present invention to the prior art that uses either semi circular halves of the disc that mate together around the mooring line, or gravity swing doors covering a slot in the disc, or a slot with a resilient cover, the present invention is a more positive system for mounting the disc on the mooring line. This is because the urging means 26 secures the disc 22 to the mooring line without the need for fitting together large halves of a vermin guard, and is more secure in preventing vermin from getting around or through the barrier than either a gravity swing door or a resilient slot cover.

CONCLUSION

Accordingly, the present invention of a marine mooring line vermin shield has been described with some degree of particularity directed to the embodiments of the present invention. It should be appreciated, though, that the present invention is defined by the following claims construed in light of the prior art so modifications or changes may be made to the exemplary embodiments of the present invention without departing from the inventive concepts contained therein.

The invention claimed is:

1. A marine mooring line vermin shield to prevent the passage of vermin crawling along a marine mooring line from land to a pleasure craft, comprising:

(a) a disc having a disc axial axis perpendicular to a face of said disc, the disc axial axis being positioned in a central portion of said disc, said disc also includes an aperture through said disc coincident to the disc axial axis being positioned such that said aperture uses the disc axial axis as a centerline, said aperture is sized and configured as a passage for the marine mooring line, said disc also includes a radial slot through said disc coincident to the disc axial axis, said radial slot extending from said aperture to a periphery of said disc, said slot having a radial axis parallel to said slot;

(b) a closure sized and adapted to insert into said slot in a closure pivotal movement arc approximately parallel to the disc axial axis, said closure is in a closed state when inserted into said slot and is substantially flush with said disc face, said closure also sized and adapted to manually extract from said slot in the closure pivotal movement arc approximately parallel to the disc axial axis, said closure is in an open state when extracted from said slot to allow the marine mooring line to pass through said slot from said periphery to said aperture, said closure including a first end substantially flush with said disc periphery when said closure is in the closed state, said closure also including an opposing second end, said closure second end is also sized and configured to removably engagably receive an aperture insert, said closure second end includes a closure retention snap void, said aperture insert includes a retention snap protrusion, wherein said void and said protrusion are removably interlockable being operational to removably retain said aperture insert on said closure second end, said aperture insert is adapted to partially compress the mooring line against said aperture when said closure is in the closed state, wherein said disc resists axial movement along the mooring line when said closure is in the closed state with said disc face generally perpendicular to a mooring line axial axis; and (c) means for urging said closure from the open state to the closed state.

2. A marine mooring line vermin shield according to claim 1 wherein said disc is constructed of a material with a mass density less than water such that said marine mooring line vermin shield floats in water.

3. A marine mooring line vermin shield according to claim 2 wherein said disc is constructed of materials selected from the group consisting essentially of polyethylene, polypropylene, and polyurethane materials.

4. A marine mooring line vermin shield according to claim 1 wherein said closure is constructed of a corrosion resistant material.

5. A marine mooring line vermin shield according to claim 1 further comprising a lock to secure said closure in the closed state.

6. A marine mooring line vermin shield according to claim 5 wherein said lock is constructed of a corrosion resistant material.

7. A marine mooring line vermin shield according to claim 1 wherein said disc face is a smooth substantially continuous surface with the exception of the marine mooring line protruding therefrom, when said closure is in the closed state, wherein the vermin encounters said disc face while crawling along the mooring line to help prevent passage of the vermin beyond said disc face.

8. A marine mooring line vermin shield according to claim 1 wherein said disc face has an area for placement of a pleasure craft registration number.

9. A marine mooring line vermin shield according to claim 1 wherein said means for urging said closure is pivotally oriented substantially parallel to the slot radial axis.

10. A marine mooring line vermin shield according to claim 9 further comprising a rod with a pivotal axis that is oriented substantially parallel to the slot radial axis.

11. A marine mooring line vermin shield according to claim 10 further including a spring element.

12. A marine mooring line vermin shield according to claim 11 wherein said rod and spring element are constructed of a corrosion resistant material.

13. A marine mooring line vermin shield according to claim 1 further comprising a plurality of aperture inserts that are operational to accommodate different sizes of mooring lines.

14. A marine mooring line vermin shield according to claim 1 wherein said closure second end and said aperture insert engage one another in a singular positional orientation.

15. A method of using a marine mooring line vermin shield to prevent the passage of vermin crawling along a marine mooring line from land to a pleasure craft, comprising the steps of:

(a) providing a marine mooring line vermin shield that includes a disc, with an aperture, and a slot, also a closure, an aperture insert, a lock, and a means for urging said closure to insert into said slot resulting in said closure being in a closed state;

(b) extracting said closure from said slot to place said closure in an open state by manually overcoming said means for urging;

(c) ascertaining the size of the mooring line;

(d) engaging said aperture insert into said closure if required based upon the size of the mooring line;

(e) positioning said slot to allow the marine mooring line to pass through said slot and to rest against said aperture such that said disc is positioned so that a substantially flush disc face faces the land; and (f) allowing said means for urging closure to insert said closure into said slot placing said closure in the closed state, wherein said closure compresses the marine mooring line against said aperture to secure said marine mooring line vermin shield against axial movement on the marine mooring line.

16. A method of using a marine mooring line vermin shield according to claim 15 further comprising a step of locking said closure in the closed state after said step (f).

17. A method of using a marine mooring line vermin shield according to claim 15 wherein said step of positioning includes an axial positioning of said aperture on the mooring line at an axial axis mooring line approximate midpoint between a mooring line cleat on the pleasure craft and a dock cleat.

18. A method of using a marine mooring line vermin shield according to claim 15 wherein said step of positioning includes an axial positioning of said aperture on the mooring line at an axial axis mooring line approximate midpoint between a mooring line cleat on the pleasure craft and an anchor on a shoreline.

19. A method of using a marine mooring line vermin shield according to claim 15 wherein said step of providing said marine mooring line vermin shield further comprises a plurality of aperture inserts to be selected from based upon mooring line size if required.

20. A method of using a marine mooring line vermin shield according to claim 19 wherein said step of engaging further comprises engaging a selected aperture insert into said closure if required based upon the size of the mooring line.

* * * * *